US007959269B2

(12) United States Patent
Leighton et al.

(10) Patent No.: US 7,959,269 B2
(45) Date of Patent: Jun. 14, 2011

(54) FUEL RAIL INK DELIVERY

(75) Inventors: Roger G. Leighton, Rochester, NY (US); Michael Leo, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 776 days.

(21) Appl. No.: 11/840,340

(22) Filed: Aug. 17, 2007

(65) Prior Publication Data

US 2009/0046131 A1 Feb. 19, 2009

(51) Int. Cl.
*B41J 2/175* (2006.01)
*B41J 29/38* (2006.01)

(52) U.S. Cl. ..... 347/85; 347/6

(58) Field of Classification Search ..... None
See application file for complete search history.

(56) References Cited

U.S. PATENT DOCUMENTS

| | | | | |
|---|---|---|---|---|
| 3,797,022 | A * | 3/1974 | Beam et al. | 347/74 |
| 4,490,731 | A * | 12/1984 | Vaught | 347/88 |
| 6,027,205 | A * | 2/2000 | Herbert | 347/54 |
| 6,179,406 | B1 * | 1/2001 | Ito et al. | 347/35 |
| 7,007,604 | B2 * | 3/2006 | Momot | 101/366 |
| 2002/0027584 | A1 * | 3/2002 | Kamanaka et al. | 347/87 |

* cited by examiner

*Primary Examiner* — Omar Rojas
(74) *Attorney, Agent, or Firm* — Marger Johnson & McCollom, P.C.

(57) ABSTRACT

A print head has an array of jets to transfer ink from the print head to a printing substrate, at least one ink supply rail to provide ink, and at least one injector to deliver ink from the ink supply rail to the print head. A printer has at least one supply to provide ink, at least one print head to transfer ink onto a printing substrate, an ink supply rail to provide ink to the print head, and an injector to deliver ink from the ink supply rail to the print head. A printing system has an array of print heads, each having at least one injector, at least one ink supply rail to deliver ink to the print heads, at least one supply to supply ink to the ink supply rail, and a transport system to transport a web substrate past the array of print heads.

20 Claims, 5 Drawing Sheets

FUEL RAIL INK DELIVERY

BACKGROUND

Solid ink jet (SIJ) printers may print on a web print substrate. A web, as that term is used here, consists of a continuous fed print substrate, such as the large roller systems used in professional printing for newspapers and magazines among other items. The web moves very quickly past the print heads compared to a print system that feeds cut sheets by a print head.

This faster substrate movement will place a much higher demand on the print heads to maintain a high ink flow rate. Without a high ink flow, the print system will become inefficient as the web would have to slow down to match a lower ink flow. This slows the entire system and the production levels of the print system would become unsatisfactory. Typical production ranges from 500 to 1000 pages per minute (ppm).

The high ink flow rate may result in internal head pressure fluctuations that in turn may cause interruptions in the printing cycle using typical ink jet printing ink flow.

DETAILED DESCRIPTION OF THE EMBODIMENTS

In a web printing apparatus the print engine receives web, or print substrates in a continuous sheet form such as a roll of paper. The web travels past a vacuum cleaner and various preparatory rolls, such as a sticky roll and a pre-heat roll. Application of ink to the web begins in the print engine at a print head assembly. As the web passes each of the print head assemblies, the print heads deliver ink to the substrate selectively according to a predefined pattern.

The web then begins its exit from the system after receiving its last ink delivery. The web may travel around a leveler drum and a radiant drum that assist in drying the ink. The web may then travels through a spreader roll pair and exits the printing apparatus via an exit roller pair. The web would then move on to a cutting process for cutting into individual sheets of paper.

This type of high-speed, large volume system requires a tremendous amount of ink at high speeds delivered to the heads at a uniform low pressure. The ink reaches the substrate via a 'jet stack' or array of small holes or nozzles through a plate or series of plates. The series of plates route the ink to the array of jets, each one individually actuated by some means such as a piezoelectric actuator vibrating a membrane to cause the membrane to push ink through its corresponding aperture. Getting the ink to the jets fast enough to keep up with the printing process gives rise to issues in ink delivery without producing pressure surges internal to the head while delivering ink.

It is possible to employ injectors, similar to fuel injectors used in the automotive technologies to deliver ink fast enough at a high enough pressure to allow the print head to meet the demand of high-speed web printing. For example, a typical automotive fuel injector runs at 60 pounds per square inch (psi), with a flow rate of 2.5 to 7 grams per second (gm/sec), can handle heats up to 200 degrees Fahrenheit. Additionally, an automotive fuel injector typically runs at 100 cycles per second (Hz), and may vary its duty cycle from 0.002 to 0.008 on (0.008 to 0.002 off).

A typical aperture plate for a fuel injector has 2 to 4 100 micrometer holes with a 2 millimeter ball welded to a plunger. The plunger may be activated by a solenoid cell such that when the solenoid receives voltage, it moves the plunger that retracts the ball away from the seat. Applying this type of structure to ink may involve altering a typical aperture plate to have larger apertures to minimize ink atomization (misting) and to enhance the flow rate.

Figure 1:
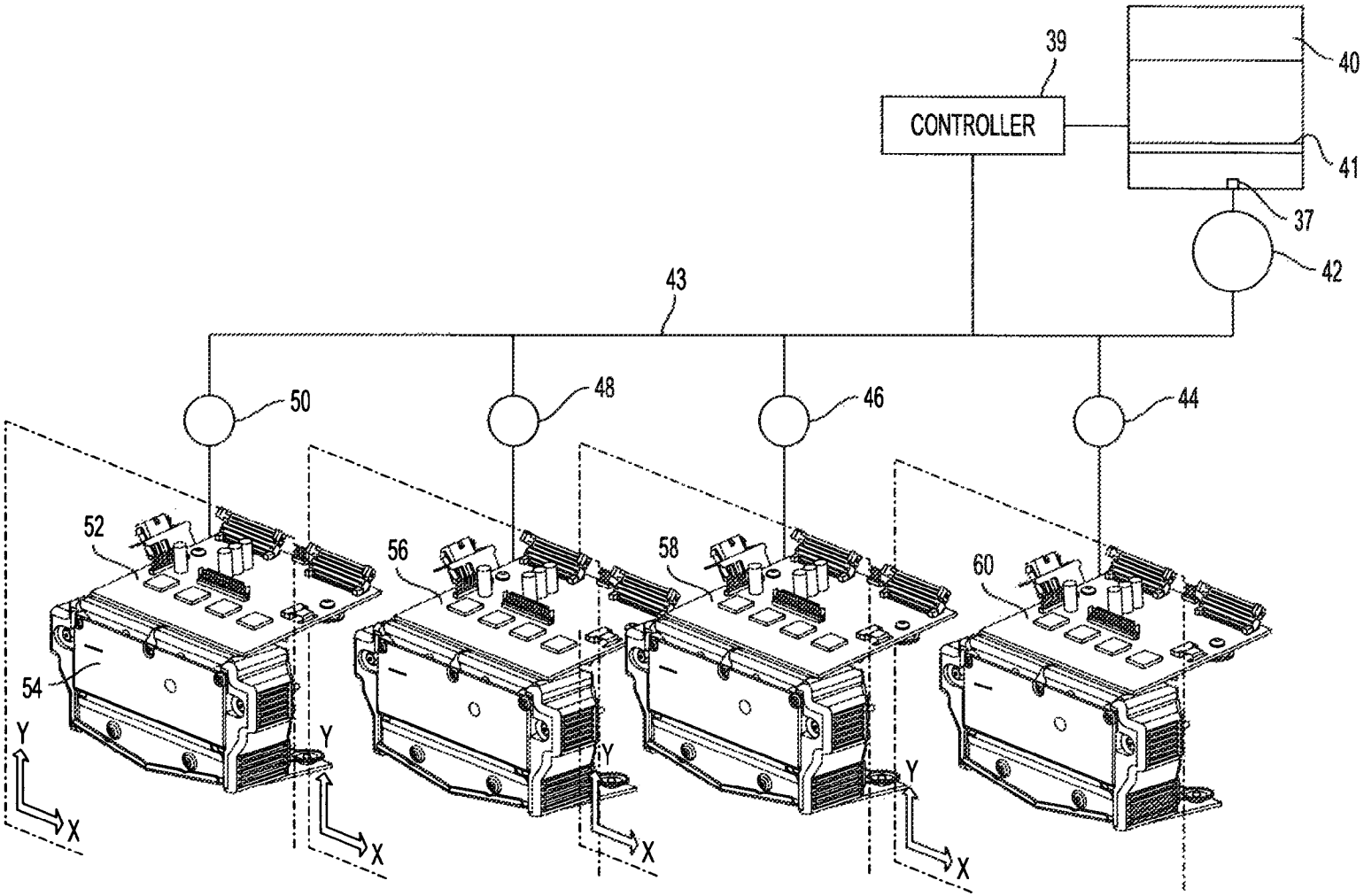
FIG. 1 shows a schematic diagram of an array of print heads fed from an injector.

FIG. 1 shows an embodiment of a system to use ink injectors. A supply tank 40 may receive an ink supply in the form of annular cylinders of solid ink or small pellets. A heating element 41 would melt the ink to ensure that a siphon 37 remains submerged in liquid ink. A pump 42 would provide the pressure to flow the ink to the print head ink injectors 44, 46, 48 and 50 with a delivery pressure of 5 to 10 psi to the fuel rail. The use of a pump allows for loading ink while running. The supply tank may also have a pressure, such as 10 psi, to ensure good ink flow with reasonably low system stresses if the tank is sealed.

The print heads show the aperture plate, or jet stack, such as 54 of print head 52. The ink injectors 44, 46, 48 and 50 feed the ink to the back side of the print heads 60, 58, 56 and 52, respectively. In the examples shown here, a single injector feeds each print head, but other embodiments may also be possible.

A controller 39 may regulate the operation of the pump, supply tank and the ink injectors to regulate the flow of ink. For example, the controller may manipulate the pump operation or the tank pressure to ensure good ink flow. The controller may also alter the duty cycle of on/off to control the flow of ink as needed by a particular print run or variations in the print run parameters, such as web speed, etc.

Figure 2:
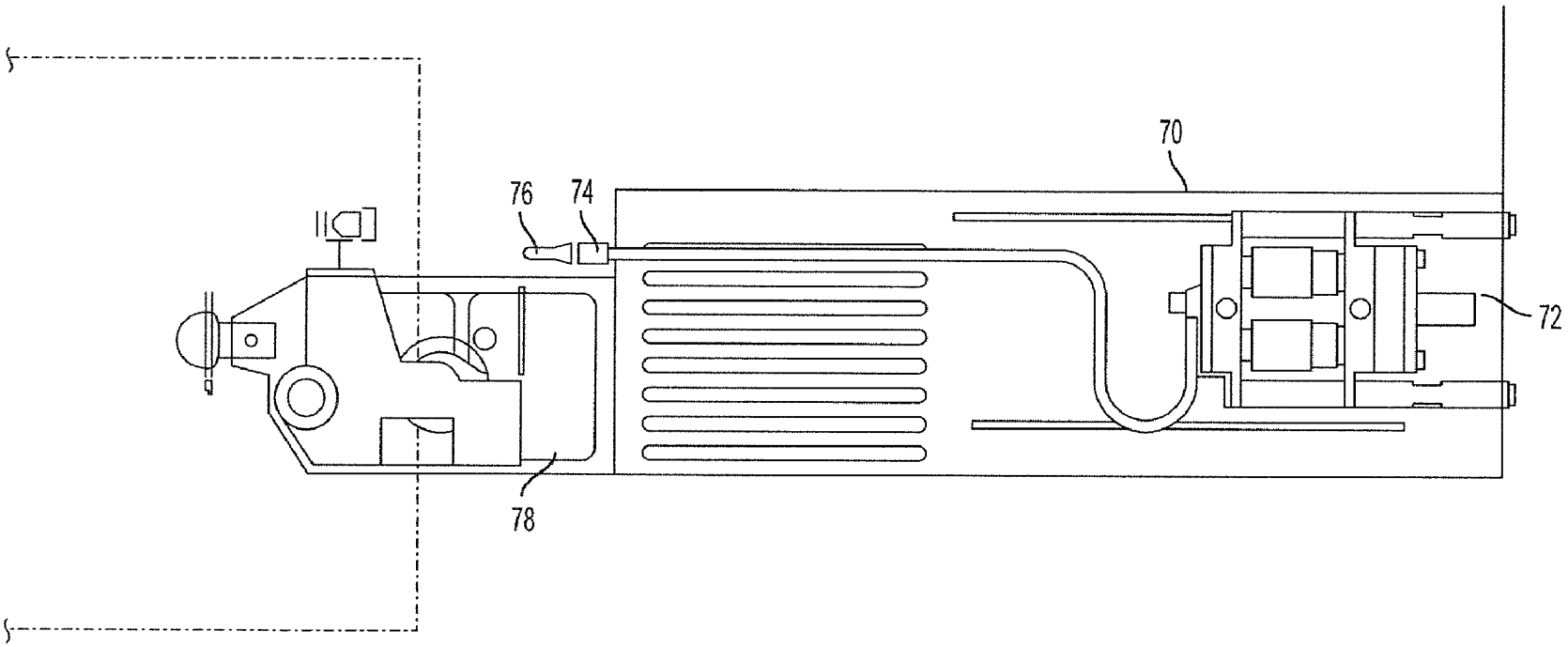
FIG. 2 shows a side view of an injector assembly.

FIG. 1 shows a simplified diagram of the print heads and injectors. FIG. 2 shows a more detailed view of a print head assembly. The assembly 70 includes an injector assembly 72, having at 4 delivery tubes 74 and a head nozzle 76. This nozzle feeds the print head 78. The fuel rail, or ink supply rail, is the tube line 43 that delivers the ink from the pump to the fuel injector assembly and the ink delivery tubes deliver the ink from the injector to the head nozzle. The print head transfers the ink to the web as it passes this print assemblies station.

Figure 3:
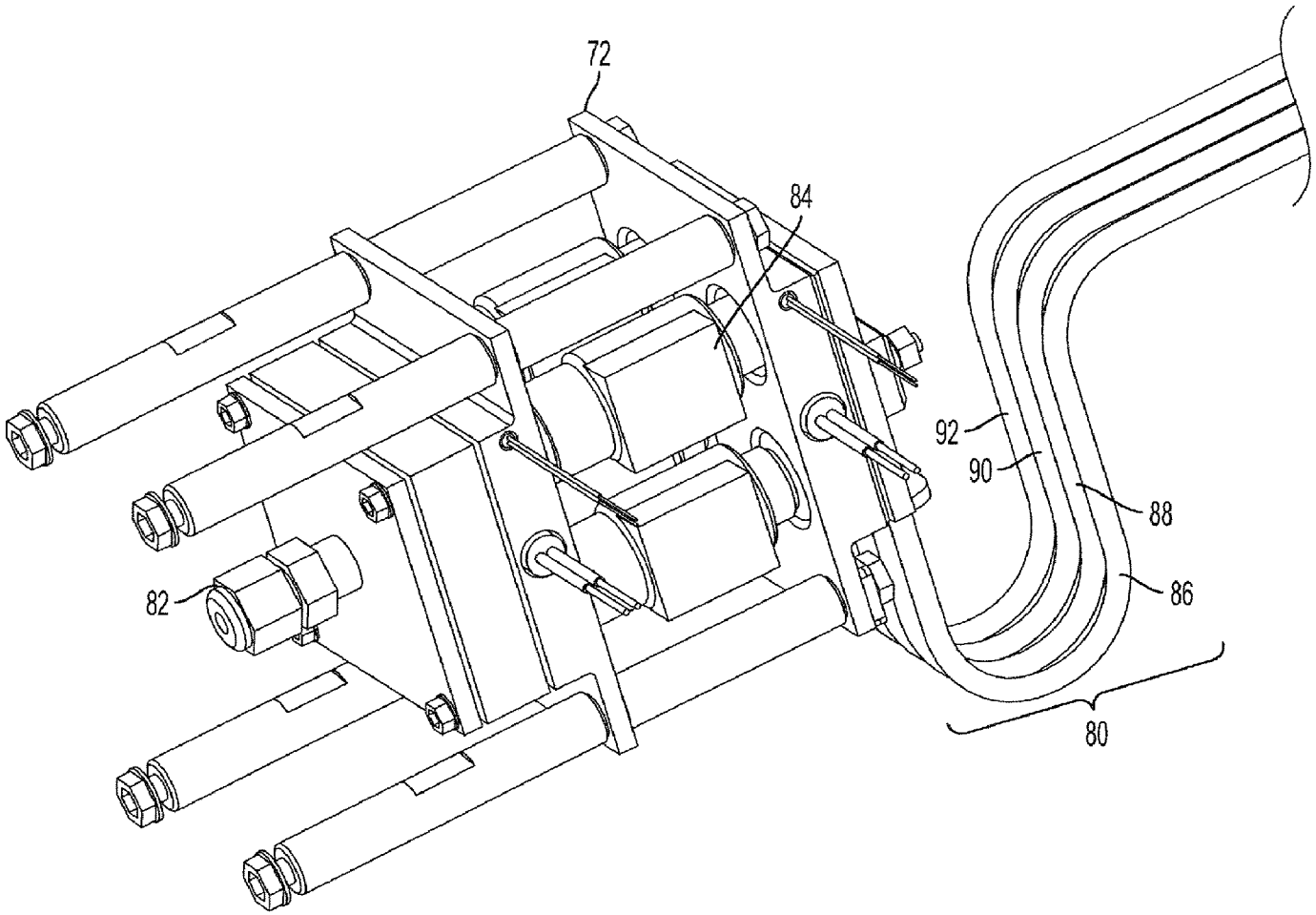
FIG. 3 shows side view of an ink distribution assembly.

A first side view of an injector assembly 72 is shown in FIG. 3. The injector assembly receives ink from the supply tank or pump through the fuel rail to port 82. The supply may come from the tank or the pump and will be referred to here more generally as the supply. The injector assembly then routes the ink through ports such as 84 through the assembly through ink delivery tubes 86, 88, 90 and 92. This example shows four delivery tubes. A high pressure rail provides ink to the injector assembly from the pump. The injector assembly feeds the ink to the injectors through ink delivery tubes, such as 86, 88, 90 and 92. The advantage of the high pressure fuel rail is that as the 10 um filter in the head increases in back pressure due to loading, the supply pressure will be able to overcome the head pressure required and increase the filter life thus extending head life.

The ink supply tubes have a u-shaped portion 80 to allow for thermal expansion. The rails to and the tubes from the injector assembly will generally have heat and insulation to keep the otherwise solid ink molten. As the system begins, the tubes will heat up, requiring some sort of thermal expansion relief. The term 'u-shaped' will include any looping or other slack structure in the ink delivery tube. The heads move with respect to each other and require compliance in the cross track direction as well. The lines must not load the nozzle with excessive side force thus cracking the nozzle to head interface which could cause ink leakage while filling.

Figure 4:
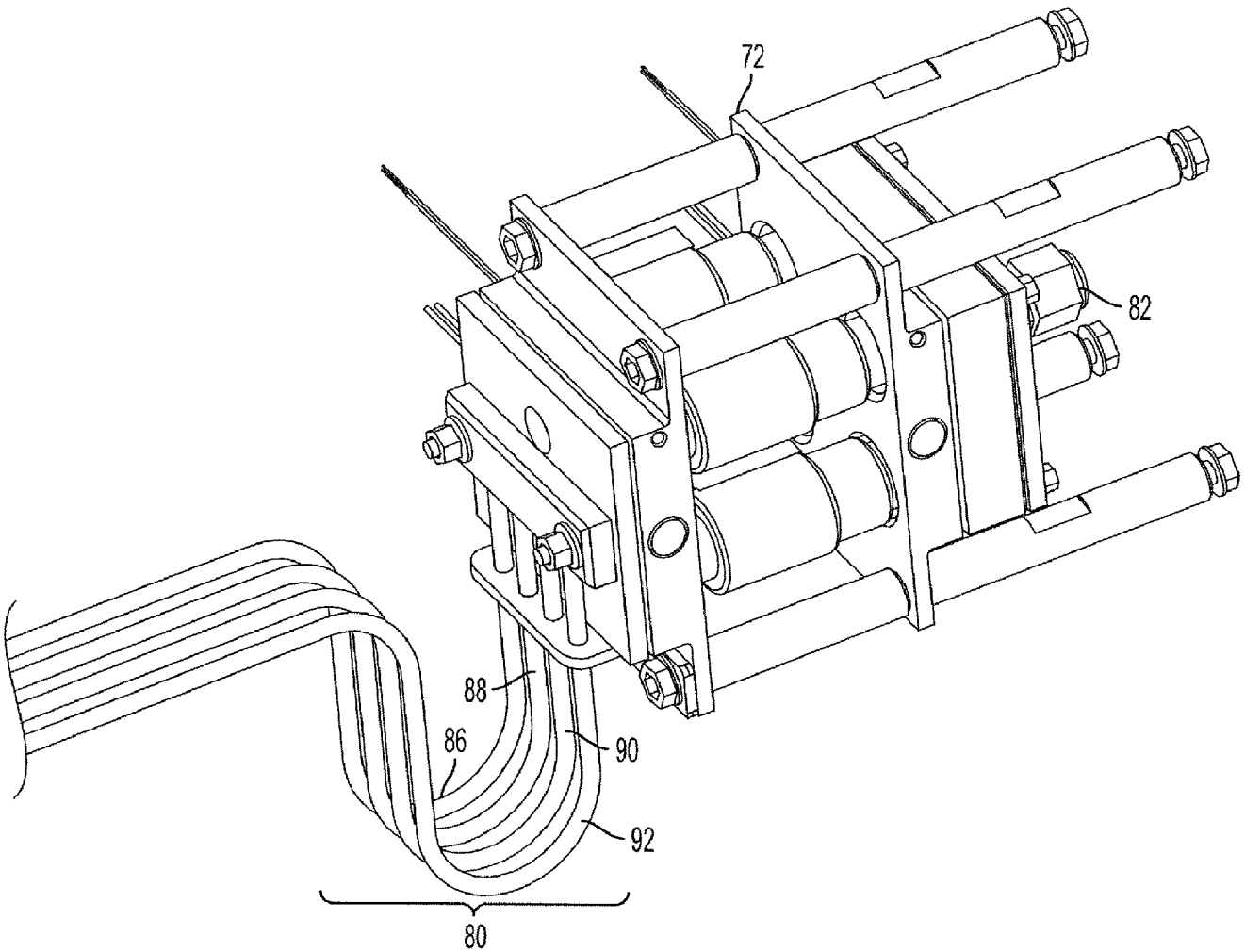
FIG. 4 shows an alternative side view of an ink distribution assembly.
Figure 5:
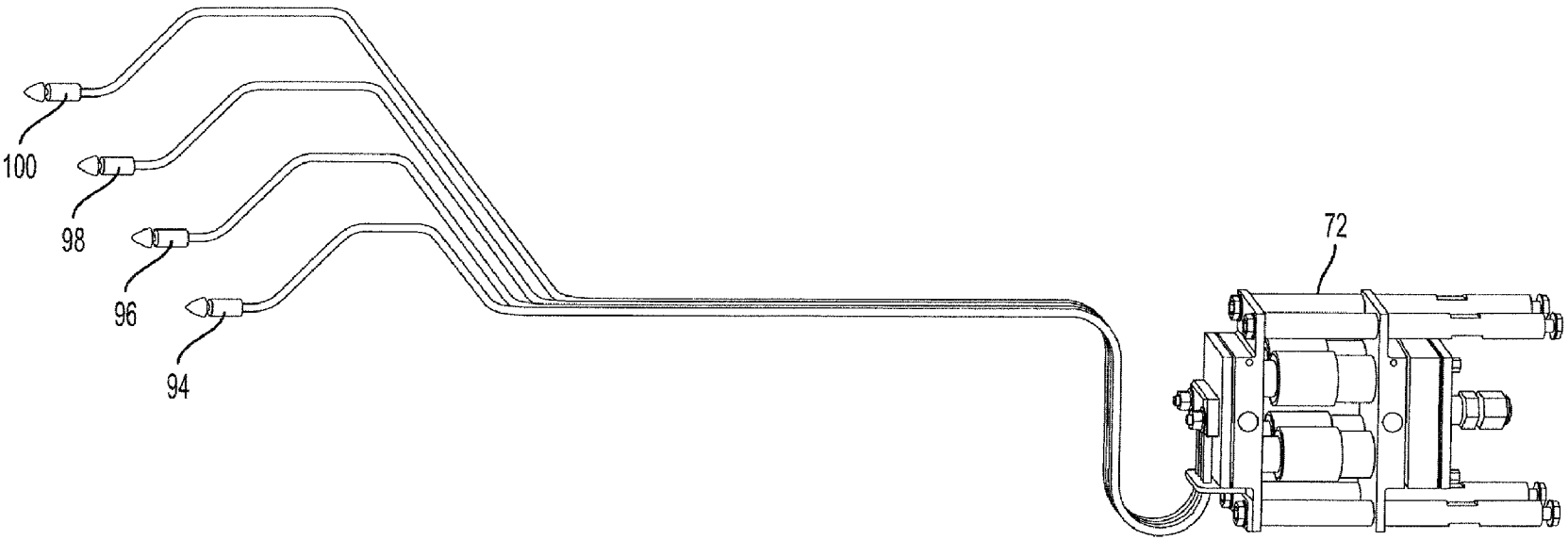
FIG. 5 shows an embodiment of ink supply rails from an ink distribution assembly.

FIG. 4 shows an alternative side view of the injector assembly 72. The port 82 resides to the back of this drawing, with the ink delivery tubes, 86, 88, 90 and 92 to the front. In this embodiment, each delivery tube feeds on ink injector that in turn feeds one single color print head. Indeed, in the embodiment shown, each of the four tubes will all carry the same color ink, as they are fed from the same ink reception rail through the port 82. FIG. 5 shows this in a more detailed view.

In FIG. 5, the injector assembly 72 feeds four ink delivery tubes, each for one of the injectors 94, 96, 98 and 100. Each color print unit typically has either three or four heads. The machine has four print units for a total of 14 heads/color. In this embodiment, then, a single injector assembly such as 72 feeds the four heads for one color. Other variations and combinations are of course possible.

For example, it is conceivable that each injector assembly may have four fuel rail lines and four output ports. Each ink supply rail would then carry a different color to the injectors. In another alternative, each supply fuel rail may feed more than one injector. Generally, that would involve some sort of ink distribution mechanism to deliver ink from one rail to multiple injectors. In yet another alternative, each injector could supply more than one print head. Again, more than likely this embodiment would present some sort of ink routing mechanism to ensure that each injection of ink be shared among the print heads.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A print head, comprising:

an ink supply under pressure at a tank pressure;

at least one ink supply rail to deliver ink under pressure from the ink supply;

at least one plunger-type injector assembly having a configured to receive ink under pressure from the ink supply rail and having a nozzle to deliver ink from the ink supply rail to ink delivery tubes to supply ink to the print head; and an array of jets in the print head to transfer ink received from the ink delivery tubes to a printing substrate.

2. The print head of claim 1, the injector having a variable duty cycle to allow control of a flow rate of the ink into the nozzle.

3. The print head of claim 1, wherein the ink supply rail has a u-shaped section to allow for thermal expansion.

4. The print head of claim 1, wherein the ink supply rail is heated and insulated.

5. The print head of claim 1, wherein at least one ink supply rail further comprises four ink supply rails.

6. The print head of claim 5, wherein at least one injector further comprises four injectors to deliver ink to the print head such that there is one injector for each ink supply rail.

7. A printer, comprising:

at least one pressurized supply to provide ink;

at least one ink supply rail to deliver ink from the supply, the ink being at a delivery pressure;

a plunger-type injector having a port configured to receive ink from the ink supply rail at pressure and a nozzle to transfer ink to ink supply tubes; and at least one print head arranged to receive ink from the ink supply tubes and having an array of jets to transfer ink onto a printing substrate.

8. The printer of claim 7, wherein at least one pressurized supply tank further comprises one pressurized supply tank per color used in the system.

9. The printer of claim 7, wherein the supply further comprises a heater to melt and one of either a siphon or pump to extract ink from the supply to the ink supply rail.

10. The printer of claim 7, wherein at least one print head further comprises at least one print head per color used in the system.

11. The printer of claim 7, wherein the injector further comprises one injector for each supply rail.

12. The printer of claim 7, wherein the ink supply rail is heated and insulated to maintain the ink in liquid form.

13. A printing system, comprising:

an array of print heads, each print head having at least one plunger-type injector to inject ink into the print head;

at least one ink supply rail to deliver ink to the print heads;

at least one supply tank having a tank pressure to supply ink at a delivery pressure to the ink supply rail; and the array of print heads arranged such that ink from the supply tank received from the ink supply rail is selectively printed on the web substrate by the print heads.

14. The printing system of claim 13, wherein the print head further comprises four ink supply tubes, each ink supply tube having an injector.

15. The printing system of claim 14, the ink supply tube having a u-shaped section to allow for thermal expansion.

16. The printing system of claim 13, the supply further comprising a heater and siphon to convert solid ink to liquid ink and to provide liquid ink to the ink delivery rail.

17. The printing system of claim 13, wherein the supply further comprises a supply pressure to create delivery pressure.

18. The printing system of claim 13, wherein the ink supply rail is heated and insulated.

19. The printing system of claim 13, wherein at least one supply tank further comprises four supply tanks, each supply tank for a different color used in the system.

20. The printing system of claim 13, the system further comprising a controller to control a duty cycle of the injector to control flow of the ink.

* * * * *